United States Patent [19]

Hamakawa

[11] Patent Number: 4,996,568

[45] Date of Patent: Feb. 26, 1991

[54] AUTOMATIC DOCUMENT FEEDER PROVIDED FOR COPYING APPARATUS

[75] Inventor: Wataru Hamakawa, Osaka, Japan

[73] Assignee: Minolta Camera Kabushiki Kaisha, Osaka, Japan

[21] Appl. No.: 250,746

[22] Filed: Sep. 29, 1988

[30] Foreign Application Priority Data

Sep. 30, 1987 [JP] Japan ..... 62-248954

[51] Int. Cl.[5] ..... G03G 15/00

[52] U.S. Cl. ..... 355/308; 355/316; 355/317; 271/110; 271/256; 271/265

[58] Field of Search ..... 355/308, 317, 316, 318, 355/319, 320, 321; 271/3.1, 10, 13, 15, 226, 227, 110, 111, 152, 153, 265, 256, 258, 259, 297, 301

[56] References Cited

U.S. PATENT DOCUMENTS

| | | | |
|---|---|---|---|
| 3,288,459 | 11/1966 | Hitchcock et al. | 271/10 |
| 4,052,054 | 10/1977 | Cardwell et al. | 271/227 |
| 4,277,165 | 7/1981 | Wada et al. | 355/311 |
| 4,575,227 | 3/1986 | Ito et al. | 355/311 X |
| 4,607,946 | 8/1986 | Uchiyama et al. | 355/311 |
| 4,615,610 | 10/1986 | Yoshiura | 355/210 |
| 4,634,263 | 1/1987 | Miwa | 358/309 |
| 4,721,381 | 1/1988 | Matsuo | 355/55 X |
| 4,727,401 | 2/1988 | Partilla et al. | 355/319 |
| 4,727,402 | 2/1988 | Smith | 355/319 |
| 4,731,637 | 3/1988 | Acquaviva et al. | 271/227 X |
| 4,775,139 | 10/1988 | Honjo et al. | 271/10 |
| 4,777,511 | 10/1988 | Takahashi | 271/226 X |
| 4,814,825 | 3/1989 | Johdai et al. | 271/186 X |

FOREIGN PATENT DOCUMENTS

| | | |
|---|---|---|
| 60-2942 | 5/1985 | Japan . |
| 6247264 | 8/1985 | Japan . |
| 60-84945 | 10/1985 | Japan . |
| 60-93463 | 11/1985 | Japan . |

*Primary Examiner*—Arthur C. Prescott

*Attorney, Agent, or Firm*—Burns, Doane, Swecker & Mathis

[57] ABSTRACT

An automatic document feeder comprising a document deck table for loading a plurality of documents in a stack, a first feeder for subsequently feeding two documents loaded on the document deck table, a second feeder for transporting a fed document onto the platen, a stopper, provided with the one end of the platen, for stopping a transported document by interfering with the end of the document, a detector for detecting a fed document, a measuring device for measuring a distance between two documents subsequently fed, based on the signal output from the detector, and a controller for putting the second feeder out of action, based on the value measured by the measuring device. In a dual feeding mode, two documents are subsequently fed one by one, the second feeder continues its action after the leading edge of the first document has interfered and stopped with the stopper. The second document is transported for a distance between the two documents after the stop of the first document, the two documents are set onto the platen in series and in close contact with each other.

4 Claims, 12 Drawing Sheets

AUTOMATIC DOCUMENT FEEDER PROVIDED FOR COPYING APPARATUS

BACKGROUND OF THE INVENTION

1. Field of the Invention

The prevent invention relates to an automatic document feeder provided for a copying apparatus, more particularly, to an automatic document feeder capable of serially arranging a pair of documents at a specified position on a platen and ejecting them after the completion of image exposure 2. Description of Related Art To reduce a time for replacing documents or to eliminate a procedure for document replacement, various copying apparatuses provided with an automatic document feeder (hereinafter abbreviated as ADF) have been recently developed and are commercially available.

Various conventional ADFs, however, feed documents one by one onto a platen. Accordingly, to perform two-document, one sided copying, an operator is supposed to replace documents and place them on the platen per sheet of document, thus time and labor are not reduced.

To avoid such disadvantages, an ADF which is capable of serially arranging two documents onto a platen has been disclosed in Japanese Patent Unexamined Publication No. 60-93462, wherein the second document is fed consecutively to the first document by a document separation device. This document feeding method is called "serial double feeding". However, commercialization of a serial double feeding ADF is difficult due to its unreliability, that is to say, accurate document feeding may not be achieved.

SUMMARY OF THE INVENTION

In view of above-mentioned problems, an object of the present invention is to provide an automatic document feeder capable of subsequently and independently feeding two documents onto a platen without simultaneously feeding the two documents together, and arranging the documents in series at a specified position with certainty.

To attain the above-mentioned object, an automatic document feeder according to the present invention comprises: means for loading a plurality of documents in a stack, means for subsequently feeding two documents loaded on said loading means, means for transporting a fed document onto said platen, means, provided with the one end of said platen, for stopping a transported document by interfering with the end of the document, means for detecting a fed document, means for measuring a distance between two documents subsequently fed, based on the signal output from said detecting means, and control means for putting said transporting means out of action, based on the value measured by said measuring means.

With the automatic document feeder constructed as above, when a dual feeding mode is selected, two of a plurality of documents loaded on the document loading means are subsequently fed one by one. The documents fed as above are each detected by the detecting means, and the distance between them is measured by the measuring means that is, for example, based on the number of rotations of a motor for the transporting means, which is indicated by pulse signals. The transporting means continues its action even after the leading edge of the first document has interfered with the stopping means and stopped at a specified position on the platen. Then, when the second document has been transported for a distance corresponding to the distance between the two documents after the stop of the first document, the transporting means is put out of action. In this case, the two documents are set onto the platen in series and in close contact with each other. Therefore, even in the case of the dual feeding mode, the automatic document feeder can not only feed two documents (in particular, it can feed the second document) with certainty but also place two documents at a specified position in series and with a satisfactory alignment. Further, both the measuring means and the document detecting means capable of issuing a pulse signal indicating the timing for starting the operation of the measuring means are also used for detecting the sizes of the first document and the second document.

BRIEF DESCRIPTION OF THE DRAWINGS

These and other objects and feature of the present invention will become apparent from the following description taken in conjunction with the preferred embodiments thereof with reference to the accompanying drawings, in which.

Drawings show a preferred embodiment of the present invention.

Figure 1:
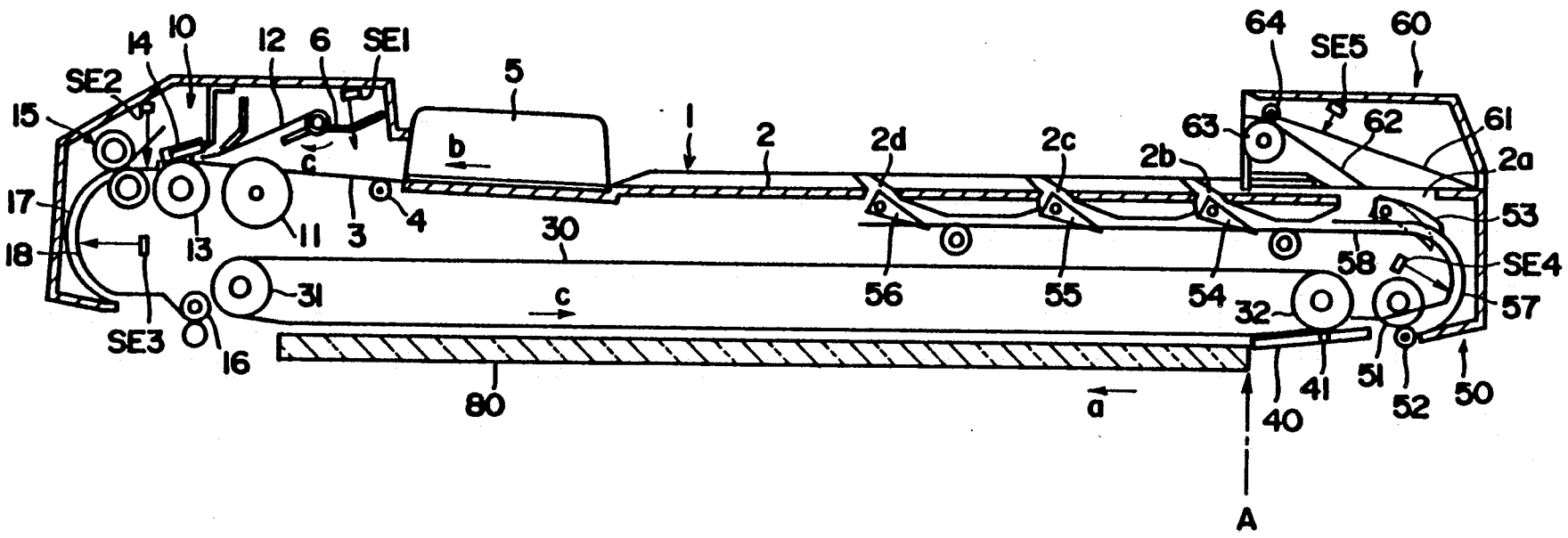
FIG. 1 is a schematic section view showing an internal composition of an automatic document feeder.

FIGS. *6a*, *6b*, *6c* and *6d* are flow charts showing a subroutine for a document transporting processing;

FIGS. *7a*, *7*i b, and *7c* are flow charts showing a subroutine for a document ejecting processing;

DETAILED DESCRIPTION OF THE PREFERRED EMBODIMENTS

The embodiment of the present invention will be described below with reference to the drawings.

With the embodiment described below, an automatic document feeder (ADF) capable of repeatedly feeding and circulating one set of documents is mounted on the top of a copying machine The copying machine is not shown in the drawings, but it has the same construction as the one described in U.S. Serial No. 188,798.

construction of ADF refer to FIG. 1.

The ADF comprises a document loading portion 1, a document feeding portion 10, a document transport belt 30, a stopper 40, and a document ejecting portion 50. Numeral 80 is a platen provided on the top surface of the copying machine. A document is illuminated by an unshown optical unit in the direction of the arrow c from the position shown by the arrow A (image exposure starting position), whereby the image is scanned onto the surface of a photosensitive drum.

The document loading portion 1 has a movable table 3 provided on the front portion of a document deck table 2, and further has a pair of side guides 5 slidable in the direction crossing at right angles with the feeding direction shown by the arrow b. Over the movable table 3, a photosensor SE1 for detecting whether any documents exist and a paddle wheel 6 for aligning documents ejected in the way as described later are disposed.

The movable table 3 can pivotally move up and down on a pivot 4, which is connected to an unshown solenoid By turning the solenoid on or off, the movable table 3 is switched to the position shown by the solid line in FIG. 1 or to the position defined by pivotally moving upward a little, i.e. the position where a feed roller 11 is hidden below the movable table 3. When the photosensor SEl detects no documents, the solenoid for actuating the movable table 3 is in the off status, whereby the movable table 3 is located back at the position defined by pivotally moving upward. In such a condition, documents are set on the loading portion 1. When the ADF is in operation and when the photosensor SEl detects any documents, the solenoid is turned off. This allows the movable table 3 to pivotally move down to the position shown by the.. solid line in FIG. 1, whereby the bottom document contacts the feed roller 11.

The feeding portion 10 comprises a document pressing plate 12 attached over the feed roller 11, a separation roller 13 in contact with and pressed by a separation pad 14 and a pair of register rollers 15 which are disposed ahead of the feed roller 11, and a pair of pinch rollers 16 is disposed in advance of the platen 80. Between the pair of rollers 15 and 16, guide plates 17 and 18 are attached Additionally, to detect a fed document, a photosensor SE2 is provided between the separation roller 13 and the pair of register rollers 15, and s photosensor SE3 is provided between the pair of register rollers 15 and the pair of pinch rollers 16. In particular, the photosensor SE3, which detects the leading edge and the trailing edge of a fed document, is used for measuring the distance between two documents and the document sizes in cooperation with pulse signals output based on the rotation of a main motor.

The document pressing plate 12, made of a flexible material, can pivotally move up and down on an unshown pivot located at the top thereof and is actuated by turning an unshown solenoid on or off The solenoid for actuating the pressing plate 12 is usually in the off status, whereby the pressing plate 12 is located at the upper position. When an ADF start signal turns on the solenoid, the pressing plate 12 is pivotally moved down to press the leading edge portion of one set of documents. This allows the bottom document to touch and press the feed roller 11, whereby a document feeding force is provided.

The feed roller 11 and the separation roller 13 are connected to a feed motor via an unshown clutch. The separation roller 13 and the separation pad 14 are provided to feed documents one by one with certainty by the difference in coefficient of friction. More specifically, assuming that the frictional force between the separation roller 13 and documents is $\mu 1$ and that the frictional force between the separation pad 14 and the documents is $\mu 2$ and that the frictional force between the documents is $\mu 3$, the relationship of these frictional forces is designated as follows:

$$\mu 1 > \mu 2 > \mu 3$$

Therefore, documents fed from the document deck table 2 by the rotation of the feed roller 11 are handled one by one by passing between the separation roller 13 and the separation pad 14.

The register rollers 15 and the pinch rollers 16 are connected to the main motor together with the transport belt 30, and a clutch capable of being turned on or off is provided between the register rollers 15 and the main motor.

The transport belt 30, an endless one, is extended from a driving roller 31 to a depending roller 32 subordinated to the rotation of the driving roller 31, covering the whole length of the platen 80. The transport belt 30 is rotated by the main motor in the direction of the arrow c to transport a fed document along the platen 80.

A stopper 40, which is positioned at the right end of the platen 80 in FIG. 1, can pivotally move up and down on a pivot 41. The pivot 41 is connected to an unshown solenoid. The solenoid is usually in the off status, whereby the top end of the stopper 40 is located under the top surface of the platen 80. When the leading edge of a fed document is detected by the photosensor SE3, the solenoid is turned on, whereby the top end of the stopper 40 protrudes above the level of A the platen 80 to stop the document transported by the transport belt 30 in the direction of the arrow c. This allows the leading edge of the document to be located at the exposure starting position (A). When the document is completely stopped by the stopper 40, the solenoid is turned off, whereby the top end of the stopper 40 is drawn back below the top surface of the platen 80. This allows for the ejection of the document.

The document ejecting portion 50 comprises a U-turn roller 51, a pinch roller 52 touching and pressing the U-turn roller 51, guide claws 53, 54, 55, and 56, guide plates 57 and 58, and an ejection unit 60. A photosensor SE4 is provided for detecting a document next to the U-turn roller 51. The U-turn roller 51 is allowed to be rotated by the main motor.

The ejection unit 60 is provided with guide plates 61 and 62, an ejection roller 63, a pinch roller 64 touching and pressing the ejection roller 63, and a photosensor SE5 for detecting a document. The ejection unit 60 is mounted on the document deck table 2 and is movable to the right and to the left on the document deck table 2 as shown in FIG. 1.

On the other hand, in the rear portion of the document deck table 2, ejecting outlets 2*a*, 2*b*, 2*c* and 2*d* are formed at the positions corresponding with each of the document sizes, where guide claws 53, 54, 55 and 56 are attached so as to allow a document to be guided into one of the ejecting outlets 2*a* through 2*d*. The respective guide claws 53 through 56 can pivotally move by an unshown cam and an unshown spring member, and they operate in conjunction with the movement of the ejection unit 60. More specifically, the guide claw 53 corresponding with the largest document size capable of being copied is usually set at the position where it is drawn back from the guide plates 57 and 58. As shown in FIG. 1, when the ejection unit 60 is set covering the ejecting outlet 2*a*, the guide claw 53 pivotally moves down to guide a document into the ejecting outlet 2*a*. The guide claws 54 through 56 are usually set at the positions where they are protruded onto the guide plate 58. When the ejection unit 60 is set covering the ejecting outlet 2*b*, a document of the second largest size is guided into the ejecting outlet 2*b* by the guide claw 54. When the ejection unit 60 is set covering the ejecting outlet 2*c*, the guide claw 54 is drawn upward to allow a document of the third largest size to be guided into the ejecting outlet 2*c* by the guide claw 55. Further, when the ejection unit 60 is set covering the ejecting outlet 2*d*, the guide claws 54 and 55 are drawn upward to allow a document of the smallest size to be guided into the ejecting outlet 2*d* by the guide claw 56.

At the start of copying operation, the ejection unit 60 is set by an operator at a position where the guide plates 61 and 62 can receive a document ejected through each of the ejecting outlets 2*a* through 2*d* corresponding with each of the document sizes. At the same time, each of the guide claws 53 through 56 is properly set so as to allow a document to be guided. Therefore, a document ejected from the platen 80 is guided into the ejection unit 60 by one of the guide claws 53 through 56 interrupting the transport path, and then the document is ejected onto the documents stacked on the document deck table 2 through rollers 63 and 64.

The ejection roller 63 is rotated by a ejection motor attached to the ejection unit 60, and the transporting speed is controlled to be higher than that of the transport belt 30 and higher than that of the U-turn roller 51. This control is provided so as to prevent the interference between two documents and ensure a certain ejection of them by ejecting the first document faster than the other when the two documents having been fed are simultaneously ejected from the platen 80 as described below.

The paddle wheel 6 is rotated in the direction of the arrow c every time a document is ejected in order to align the ejected document onto the documents already placed on the document deck table 2.

operation of ADF

One sequence of operation of the ADF constituted as above is described below.

First, each document is stacked with the image side face up on the document deck table 2. At the same time, the positions of the side guides 5 and the ejection unit 60 are regulated by an operator. Then, the positions of the guide claws 53 through 56 are properly set according to the position of the ejection unit 60, whereby the ADF gets ready to guide a document into the ejection unit 60.

When the operation of the ADF is started, the movable table 3 is pivotally moved to the position defined by the solid line in FIG. 1, whereby the bottom of the documents contacts the feed roller 11. Simultaneously, the document pressing plate 12 is moved down to provide a feeding force. At this moment, the feed motor and the main motor are turned on to rotate the feed roller 11 and the separation roller 13, whereby the bottom document is fed. The feeding operation for the next document is started based on a document exchanging signal output from a control unit of the copying machine after the completion of the copying operation for the previous document.

The leading edge of the fed document interferes with the pair of register rollers 15 and is registered. When a specified time has passed after the photosensor SE2 detected the leading edge of the document, the clutch to the pair of register rollers 15 is turned on, whereby the document is transported onto the platen 80 by the rotation of the register rollers 15. When the leading edge of the fed document has at least reached the Pair of pinch rollers 16, the pressure of the pressing plate 12 is canceled, and the clutch of the register rollers 15 and the main motor are turned off. After that, the document is transported by the pinch rollers 16 and the transport belt 30 while the register rollers 15 are rotated following the operation of the one-way clutch.

In the case of the dual feeding mode, when the trailing edge of the first document is detected by the photosensor SE2, the feeding operation for the second document is started.

When the leading edge of the first document is detected by the photosensor SE3, a stop timer for stopping the rotation of the transport belt 30 is set. The stop timer is preset for a time to be spent feeding the leading edge of the document from the detecting point of the photosensor SE3 to the exposure starting position (A). When the operation for detecting the document size is started, the stopper 40 is set at the document stopping position.

When the trailing edge of the document is detected by the photosensor SE3, the document size detecting operation is completed. Simultaneously, in the case of the dual feeding mode, the operation of a space counter for measuring the distance between two documents is started. The space counter counts pulses output based on the rotation of the main motor.

In the case of the dual feeding mode, when the leading edge of the second document having been fed is detected by the photosensor SE3, the space counter completes the count, that is, measuring the distance between the first document and the second document is completed. The measured value is added to the value of the stop timer, and at the same time the detecting operation for the second document size is started. The detecting operation for the second document size is completed when the trailing edge of the second document is detected by the photosensor SE3, whereby a signal for indicating the total document length obtained by adding the second document size to the first document size is transmitted to the control unit of the copying machine.

When the stop timer is completed, the main motor is turned off, and the rotation of the transport belt 30 is stopped. In this case, the first document is stopped in a state where the leading edge thereof is located at the exposure starting position (A) by interfering with the stopper 40. In the case of the dual feeding mode, the transport belt 30 is further rotated for the distance between two documents, which has been measured by the space counter. This allows the second document to be stopped in a state where the leading edge thereof is in close contact with the trailing edge of the first document, whereby the two documents are placed side by side in series on the platen 80. Then, a copying start signal is output to the control unit of the copying machine based on the completion of the stop timer, whereby the copying operation is started.

The copying operation is executed under the conditions where both a copying sheet size and a copying magnification have been selected in advance by an operator. Or it is executed under the operation of an automatic copying magnification selected system wherein a copying sheet size is previously selected or under the operation of an automatic copying sheet size selecting system wherein a magnification is previously selected. The copying sheet sizes and copying magnifications optimum for the dual feeding mode are listed in Table 1.

TABLE 1

| Document sizes | Copying sheet sizes | Magnification |
|---|---|---|
| Two documents | A3 size longitudinal | ×1.000 |
| A4 size latitudinal | A4 size longitudinal | ×0.707 |
| | B4 size longitudinal | ×0.816 |
| Two documents | A3 size longitudinal | ×1.154 |
| B5 size latitudinal | B4 size longitudinal | ×1.000 |
| | A4 size longitudinal | ×0.816 |

TABLE 1-continued

| Document sizes | Copying sheet sizes | Magnification |
|---|---|---|
| | B5 size longitudinal | ×0.717 |

When the copying operation for the predetermined number of copies has been completed, the document exchanging signal is output from the control unit of the copying machine, and it turns on the main motor and ejection motor. This allows the transport belt 30, the U-turn roller 51 and the ejection roller 63 to be rotated, whereby the two documents start to be ejected from the platen 80. Further, when the trailing edge of the second document is detected by the photosensor SE4, the next document waiting at the pair of register rollers 15 starts to be transported.

Figure 2:
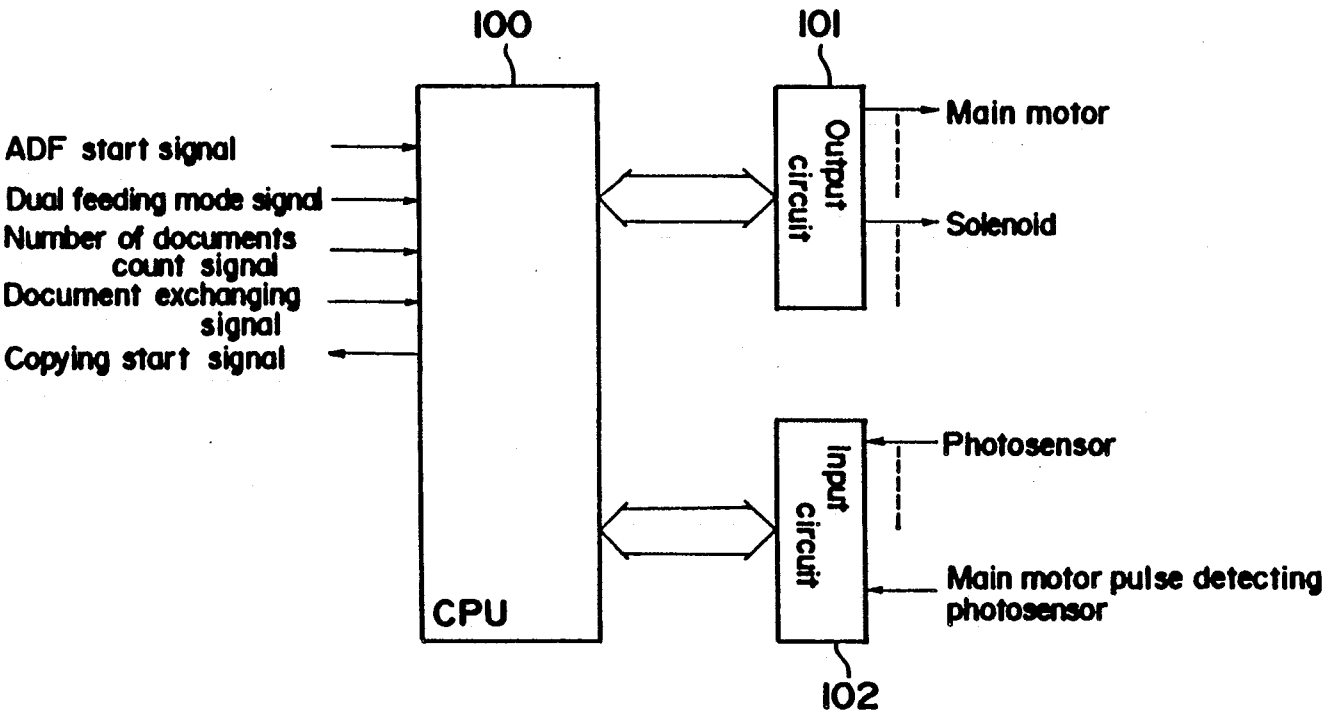
FIG. 2 is a schematic block diagram showing a control circuit.

The documents ejected from the Platen 80 are guided into the ejection unit 60 by one of the guide claws 53 through 56 having been already set according to the document size, and then ejected onto the document deck table 2 through the ejection roller 63 and the pinch roller 64. In this case, the ejection roller 63 whose transporting speed is set a little higher feeds the first document faster than it feeds the second document, widening the space between them, whereby the interference between the two documents is prevented. Additionally, the paddle wheel 6 is rotated based on a signal indicating that the photosensor SE5 has detected the trailing edge of the document, whereby the ejected documents are properly aligned.

control circuit refer to FIG. 2

A control circuit for controlling the operation of the ADF is described below.

A microprocessor 100 (hereinafter abbreviated as CPU) is the center of the control, where an ADF start signal, a dual feeding mode signal and a document exchanging signal are input from the control unit of the copying machine while a copying start signal is output from the CPU 100. Further, to the CPU 100, the main motor, feed motor, ejection motor, the motor for the paddle wheel 6 and various solenoids are connected via an output circuit 101, and each of the photosensors SEl through SE5 and a photosensor for detecting pulse of the main motor and for actuating the counter are connected via an input circuit 102.

control procedure refer to FIGS. 3 through 7*c*

The control procedures of the CPU 100 is described below.

Figure 3:
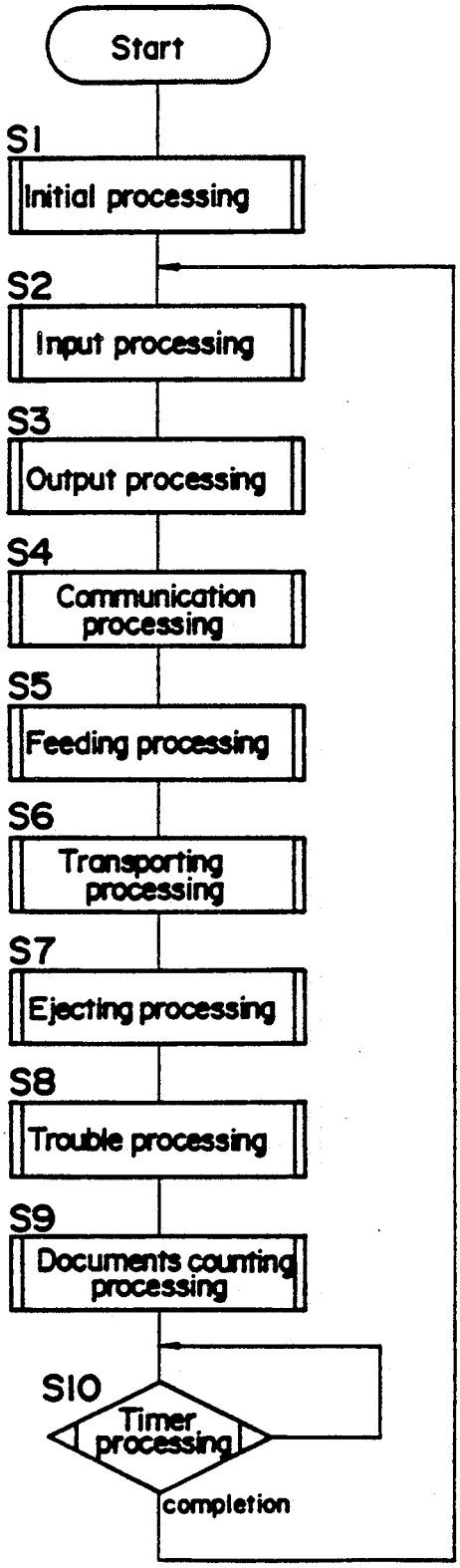
FIG. 3 is a flow chart showing a main routine of a microprocessor.

FIG. 3 shows the main routine of the CPU 100.

When the power is turned on, the CPU 100 is reset to start the program. At step S1, the CPU 100 clears the random access memory (RAM) and initializes various registers and devices.

Next, the subroutines in steps S2 through S9 are sequentially called, and at step S1O the subroutine for the timer processing is executed. In this subroutine, the main timer determines the duration required for one cycle of the main routine, and after waiting the completion of counting cycle of the main timer the processing returns to said step S2. The count of timers used in each of the subroutines is performed based on the duration required for one cycle of the main timer.

At step S2, the subroutine is executed to judge the state of the input port of the CPU 100, i.e. whether the signal status of each of the photosensors SE1 through SE5 is on, off, edge status or the like.

At step S3, the subroutine is executed to judge the state of signals outPut from the outPut Port of the CPU 100.

At step 4, the subroutine is executed for processes and communications based on various signals transmitted from the CPU on the copying machine, as described later in detail.

At step S5, the subroutine is executed to feed documents, as described later in detail.

At step S6, the subroutine is executed to transport documents onto the platen 80 and stop them there, as described later in detail.

At step S7, the subroutine is executed to eject documents from the platen 80 onto the document deck table 2, as described later in detail.

At step S8, the subroutine is executed to detect such trouble as document jamming or the like. The jamming is detected by a combination of photosensors and timers according to the conventional method.

At step S9, the subroutine is executed to count the number of documents loaded on the document loading portion 1. The number of documents to be loaded is inputted in advance into the control unit of the copying machine by an operator.

Figure 4:
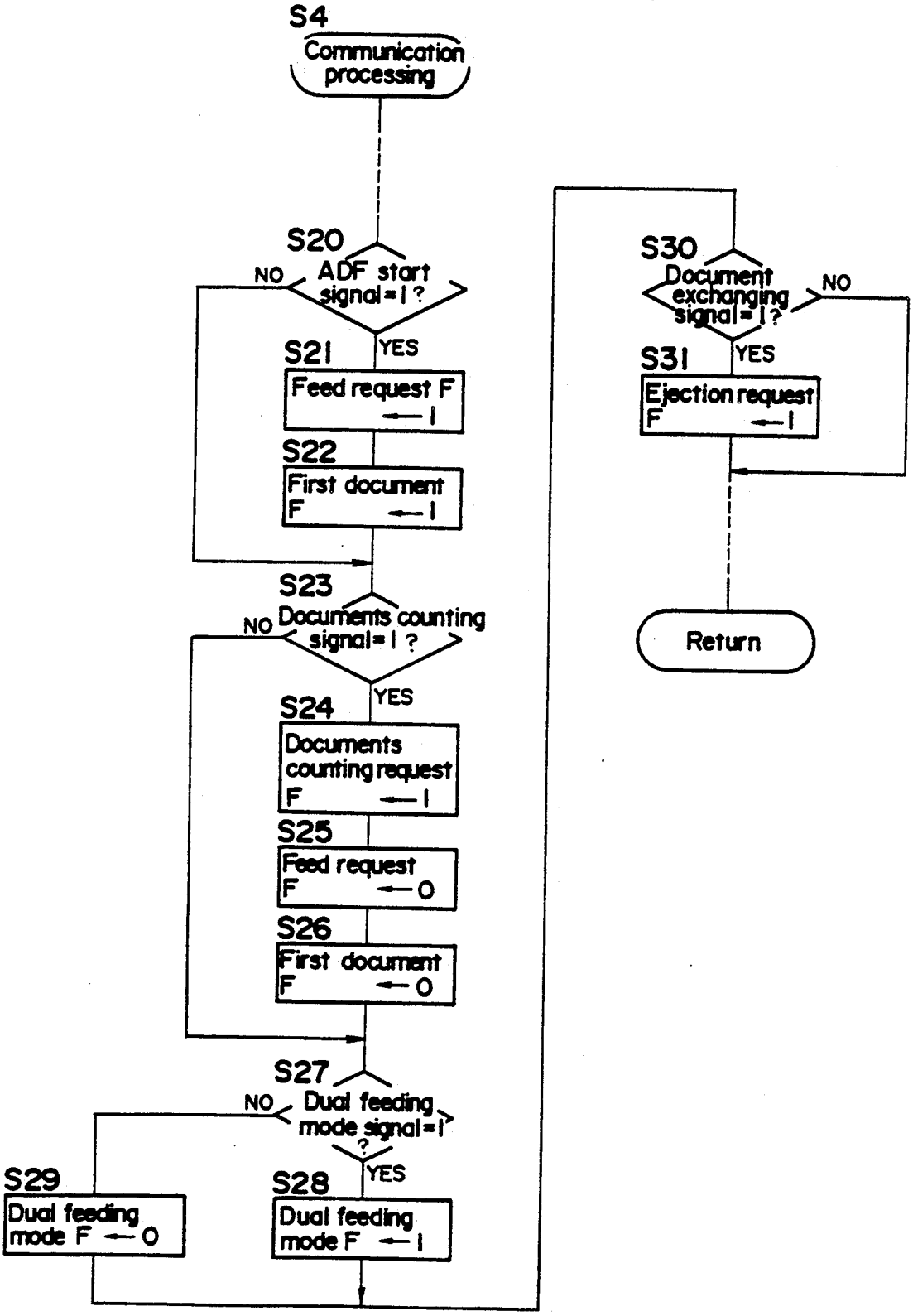
FIG. 4 is a flow chart showing a subroutine for a communication processing.

FIG. 4 shows the subroutine for the communication processing relating to the invention to be executed at step 4 of the main routine.

First, when it is confirmed at step S20 that the ADF start signal is "1", at step S21 a feed request flag is set to "1", and at step S22 a first document flag is set to "1". The feed request flag is a flag to request the ADF to start the document feeding operation. The first document flag is a flag to indicate that a document to be fed is the first one.

Next, when it is confirmed at step S23 that a documents counting signal is "1", at step S24 a documents counting request flag is set to "1", at step S25 the feed request flag is reset to "0", and at step S26 the first document flag is reset to "0". The documents counting request flag is a flag to execute the subroutine at step S9.

Next, it is judged at step S27 whether a dual feeding mode signal is "1". When the signal is "1", at step S28 a dual feeding mode flag is set to "1". When the signal is "0", at step S29 the dual feeding mode flag is reset to "0". The dual feeding mode flag is a flag to indicate that the dual feeding mode is selected.

On the other hand, when it is confirmed at step S30 that a document exchanging signal is "1", at step S31 an ejection request flag is set to "1". The ejection request flag is a flag to request the operation for ejecting documents from the platen 80.

Figure 5:
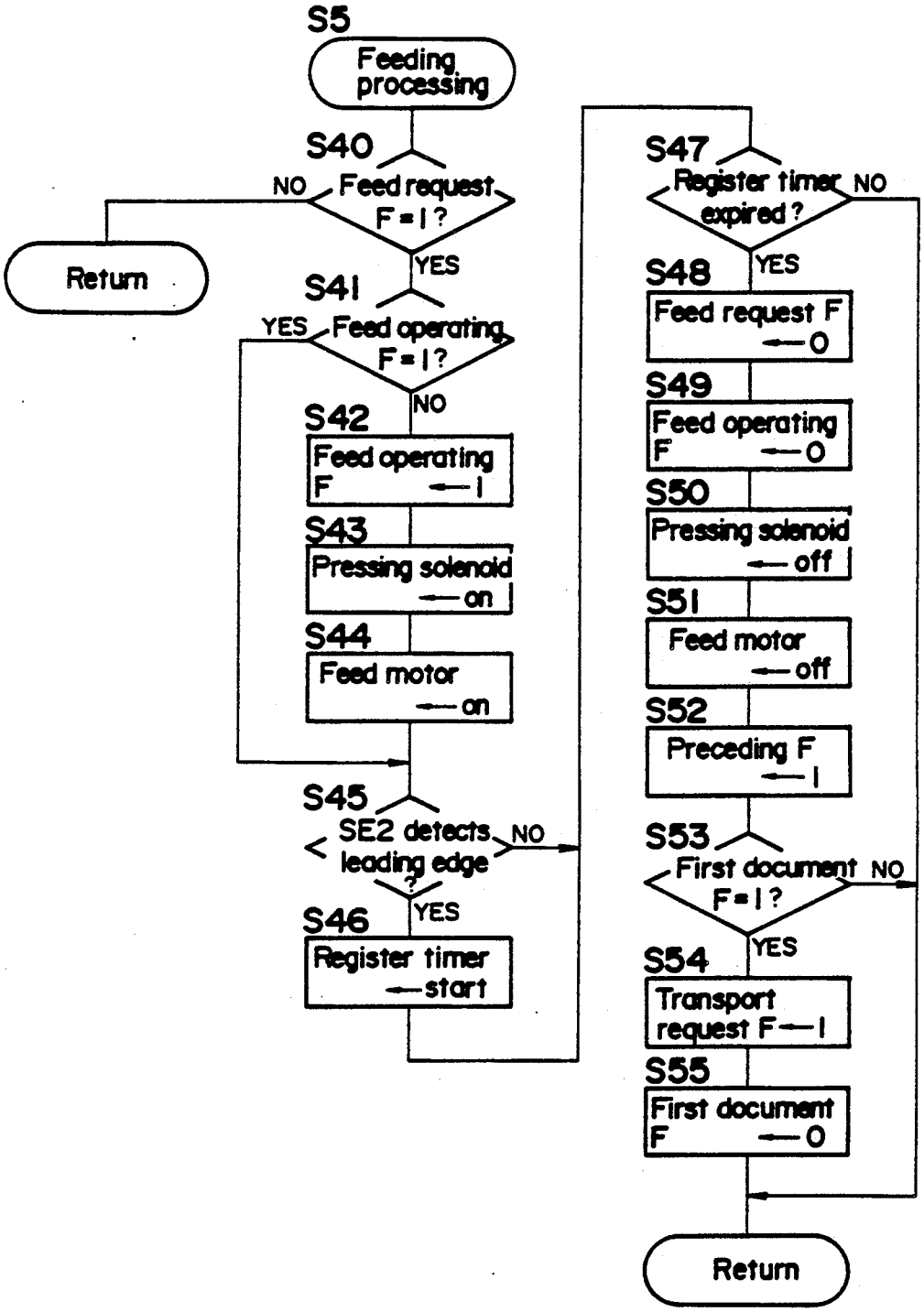
FIG. 5 is a flow chart showing a subroutine for document feeding processing.
Figure 6A:
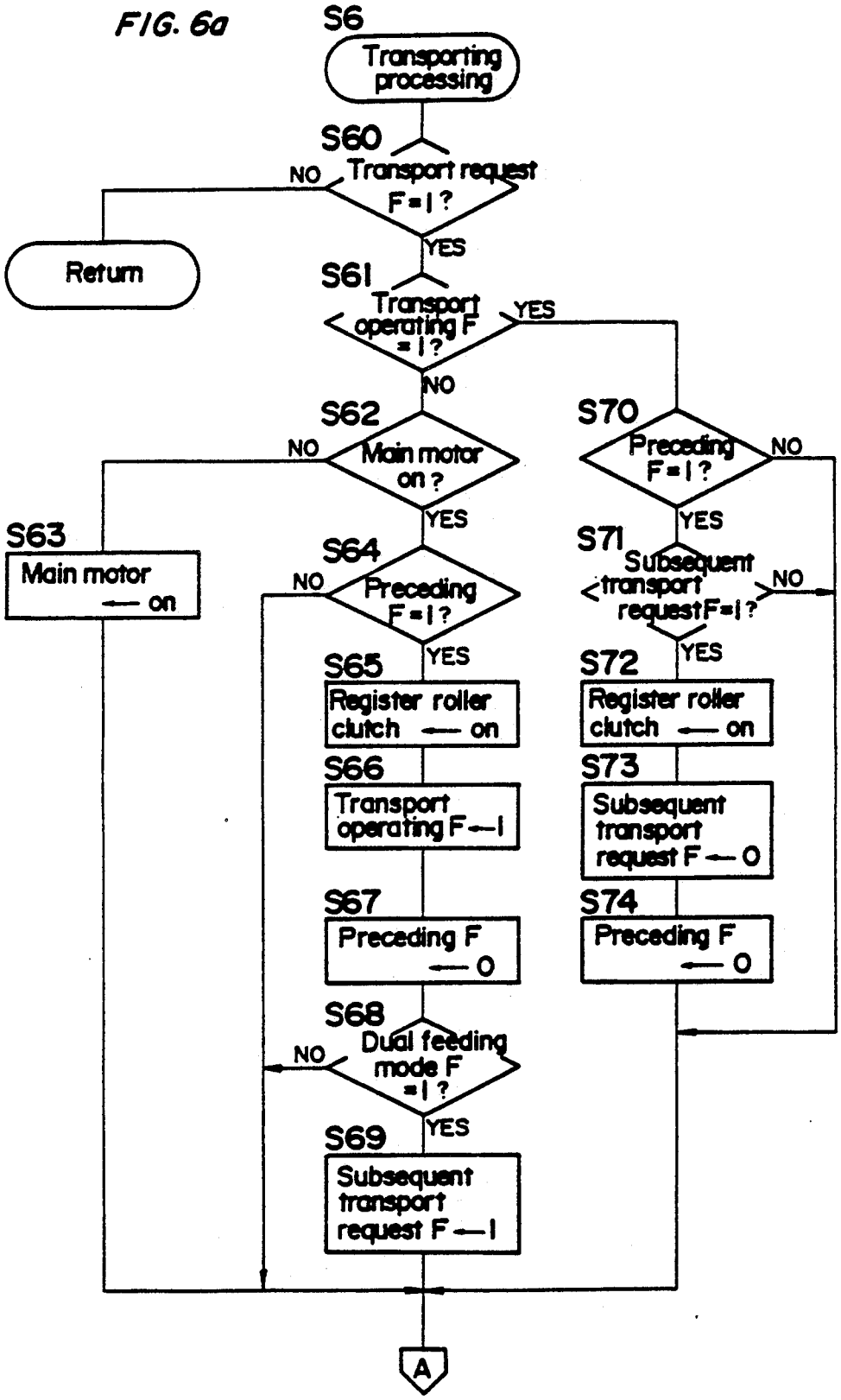
Figure 6B:
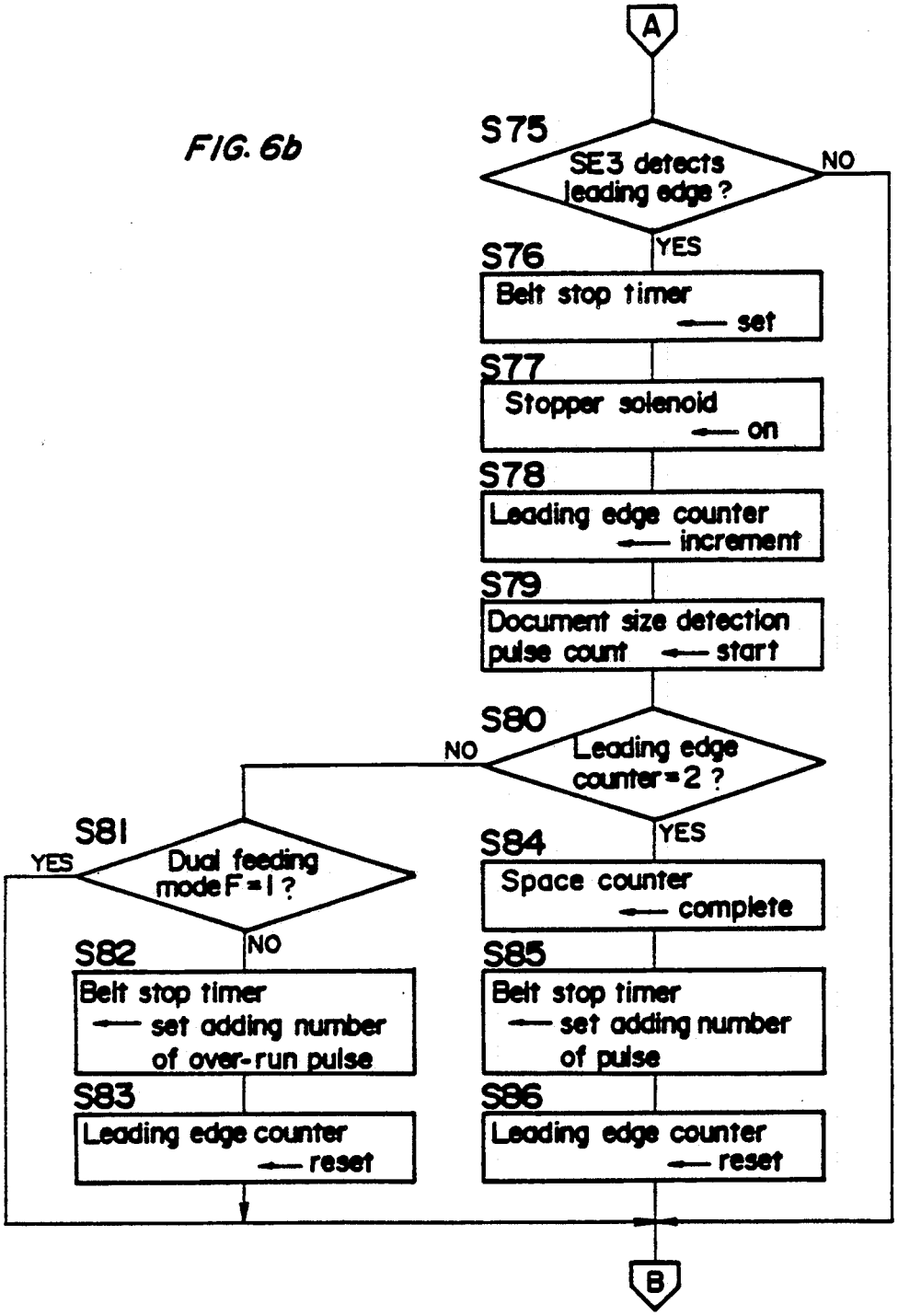
Figure 6C:
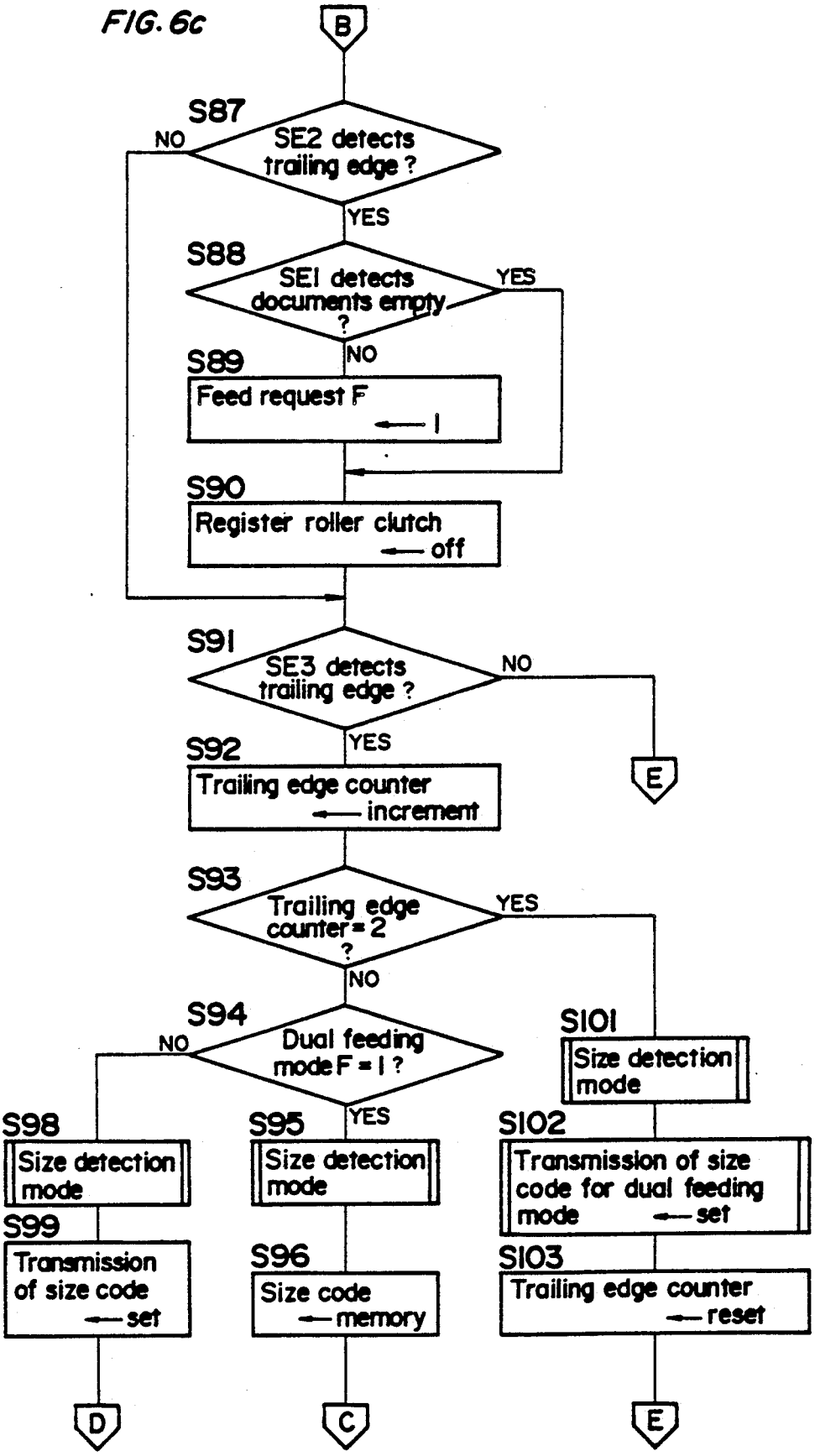
Figure 6D:
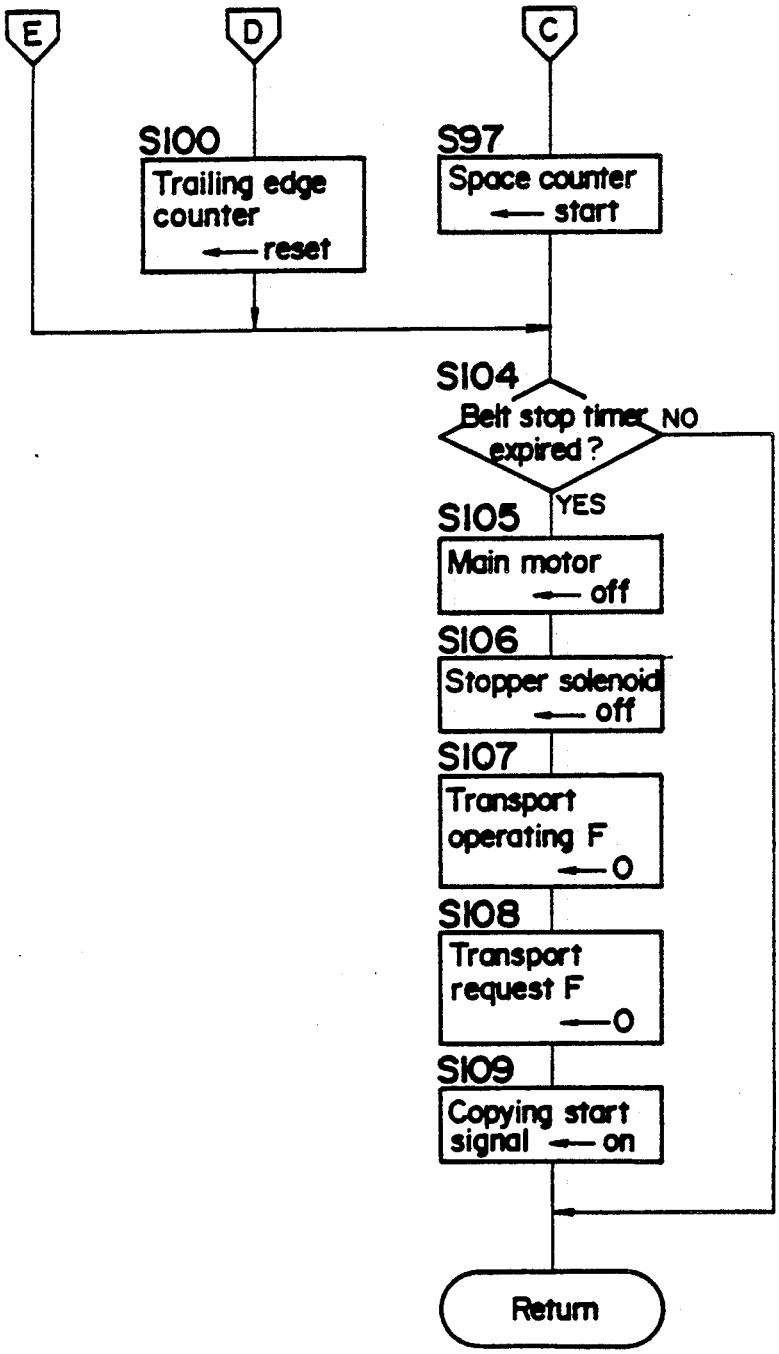

FIG. 5 shows the subroutine for the document feeding processing to be executed at step S5 of the main routine First, it is judged at step S40 whether the feed request flag is "1". When the flag is "0", the processing returns to the main routine at once. When the flag is "1", it is judged at step S41 whether a feed operating flag is "1". When the feed operating flag is "1", it indicates that the document feeding operation is in progress. In that case, the processIng proceeds to step S45 because the document feeding operation is currently in progress. On the other hand, when it is judged at step S41 that the feed operating flag is "0", the flag is set to "1" at step S42, the pressing solenoid is turned on at step S43, and the feed motor is turned on at step S44. With those processing, the pressing plate 12 presses the upper surface of one set of documents, and the feed roller 11 and the separation roller 13 are rotated so as to feed a document. Next, at step S45 it is judged whether the photosensor SE2 has detected the leading edge of the fed document. When the photosensor SE2 has not detected it, the processing proceeds to step S47. When the photosensor SE2 has detected it , a register timer is started at step S46. The register timer is preset at the value obtained by adding a margin for overrun of approximately 10 mm to the distance between the detecting point of the photosensor SE2 and the register rollers 15, and for the proper alignment of the document, it ensures that the leading edge of the fed document interferes with the register rollers 15 (preventing an inclination of it).

Further, after waiting the completion of counting cycle of the register timer at step S47, the feed request flag is reset to "0" at step S48, the feed operating flag is reset to "0" at step S49. The pressing solenoid is turned off at step S50, and the feed motor is turned off at step S51. This allows the document feeding operation to be stopped in a state where the leading edge of the document is properly aligned by interfering with the register rollers 15. Furthermore, at step S52 a preceding flag is set to "1". When the preceding flag is "1", it indicates that a document is currently waiting at the register rollers !5.

Next, it is judged at step S53 whether the first document flag is "1". When the flag is "0", the subroutine is terminated. When the flag is "1", a transport request flag is set to "1" G. at step S54, the first document flag is reset to "0" at step S55, and the subroutine is terminated. The document transport request flag is a flag to request the document to be further transported onto the platen 80.

FIGS. *6a, 6b, 6c* and *6d* show the subroutine for the document transporting processing to be executed at step S6 of the main routine.

First, it is judged at step S60 whether the transport request flag is "1". When the flag is "0", the processing returns to the main routine at once. When the flag is "1", it is judged at step S61 whether a transport operating flag is "1", that is, whether the document transporting operation is in progress. When the transport operating flag is "1", the processing proceeds to step 70 because the document transporting operation is currently in progress. When the flag is "0", it is judged at step S62 whether the main motor is in the on status. When not in the on status, the main motor is turned on at step S63 to rotate the pair of pinch rollers 16 and the transport belt 30, whereby the transport belt 30 gets ready to feed a document, and the processing proceeds to step S75.

On the other hand, when it is judged at said step S62 that the main motor already is turned on, it is judged at step S64 whether the preceding flag is "1". When the flag is "0", the processing proceeds to step S75 at once. When the flag is "1" at step S65 the clutch of the register rollers 15 is turned on. Therefore, the pair of register rollers 15 begins to rotate and transports the waiting document onto the platen 80. Further, the transport operating flag is set to "1" G. at step S66, the preceding flag is reset to "0" G. at step S67. Subsequently, it is judged at step S67 whether the dual feeding mode flag is "1". When the flag is "0", the processing proceeds to step S75. When the flag is "1", a subsequent transport request flag is set to "1", and the processing proceeds to step S75. The subsequent transport request flag is a flag to start the document transporting operation for the second document waiting at the pair of register rollers 15 in the dual feeding mode.

When it is judged at said steP S61 that the transPort operating flag is "1", i.e. when the first document is on the way to be transported onto the platen 80, it is judged at step S70 whether the preceding flag is "1". Subsequently, it is judged at step S71 whether the subsequent transport request flag is "1". When one of the flags is "0", the processing proceeds to step S75. When both the flags are "1", the clutch of the register rollers 15 is turned on at step S72, the subsequent transport request flag is reset to "0", the preceding flag is reset to "0" G. at step S74, and the processing proceeds to step S75. This allows the second document to be transported onto the platen 80.

Next, at step S75, it is judged whether the photosensor SE3 has detected the leading edge of the second document being transported. When the photosensor SE3 has not detected it, the processing proceeds to step S87. When the photosensor SE3 has detected it, a stop timer for stopping the rotation of the transport belt 30 is set at steP S76. The stop timer is preset so as to count pulses output based on the rotation of the main motor, and the preset number of the pulses is corresponding to a distance from the detecting point of the photosensor SE3 to the document stopping position by the stopper 40 (the exposure starting position (A)). Then, at step S77 the stopper solenoid is turned on to move the stopper 40 to the document stopping position. Further, at step S78 a counter for checking whether the transported document is the first document or the second document is increased in value by an increment. The counter is arranged as above so that the value thereof is increased by an increment when the leading edge of a document is detected by the photosensor SE3. More specifically, when the first document is detected, the value is counted as "1". When the second document is detected, the value is counted as "2". Furthermore, at step S79 pulse signals output based on the rotation of the main motor start to be counted so as to detect the document size.

Next, at step 80, it is judged whether the value counted by the leading edge counter is "2". At step S81, it is judged whether the dual feeding mode flag is "1". More specifically, it is judged whether the document whose leading edge has been judged to be detected by the photosensor SE3 at said step S75 is the first document in the dual feeding mode, the second document in the same mode, or a document in the usual document feeding mode.

The judgments at steps S80 and S81 and the sorts of documents are listed in Table 2.

TABLE 2

| Value of leading edge counter | Status of dual feeding mode flag | Sorts of feeding mode and document |
|---|---|---|
| "1" | "1" | First document in dual feeding mode |
| "1" | "0" | Usual feeding mode |
| "2" | "1" | Second document in dual feeding mode |

Therefore, in the case of the first document in the dual feeding mode, i.e. when the judgment is "No" at step S80 and when the judgment is "Yes" at step S81, the processing proceeds to step S87. In the case of a document in the usual document feeding mode, i.e. when the judgment is "No" at step S80 and when the judgment is "No" at step S81, the stop timer is set to a value obtained by adding the number of pulses required for a overrun of approximately 10 mm. This arrangement is provided so as to improve the alignment of a document by letting the leading edge of a document interfere with the stopper 40. Further, the leading edge counter is reset at step S83, the processing proceeds to step S87.

In the case of the second document in the dual feeding mode, i.e. when the judgment is "Yes" at step S80, the measurement with the space counter is completed at step S84. The space counter is started at step S97 in this subroutine described later, in order to measure the distance between the first document and the second document in the case of the dual feeding mode by counting pulse signals output based on the rotation of the main motor. At step S85, the stop timer is set to a counting value obtained by adding the number of pulse signals corresponding to the distance measured by the space counter. This allows the second document to continue to be transported even after the leading edge of the first document has been properly aligned by interfering with the stopper 40, whereby the second document is stopped at the position where it comes into close contact with the first document. Further, the leading edge counter is reset at step S86, and the processing proceeds to step S87.

Next, it is judged at step S87 whether the photosensor SE2 has detected the trailing edge of the fed document. When the photosensor SE2 has not detected it, the processing proceeds to step S91. When the photosensor SE2 has detected it, it is judged at step S88 whether the photosensor SEl is detecting that any documents exist on the document deck table 2. When any documents exist, at step S89 the document feed request flag is set to "1"G. so as to feed the next document. Simultaneously, the clutch of the register roller 15 is turned off at step S90. When no documents exist, the clutch is turned off similarly at step S90. Even if turned off at this step, the clutch having a one way function allows the pair of register rollers 15 to be rotated as the document is transported.

Next, it is judged at step S91 whether the photosensor SE3 has detected the trailing edge of the document. When the photosensor SE3 has not detected it, the processing proceeds to step S104. When the photosensor SE3 has detected it, a counter for checking whether the transported document is the first or the second is increased in value by an increment. The counter is arranged as above so that the value thereof is increased by an increment when the trailing edge of a document is detected by the photosensor SE3. More specifically, when the first document is detected, the value is counted as "1"; when the second document is detected, the value is counted as "2", as the same as the leading edge counter.

Furthermore, it is judged at step S93 whether the value by the trailing edge counter is "2"G. And it is judged at step S94 whether the dual feeding mode flag is "1". More specifically, it is judged whether the document of which the trailing edge has been judged to be detected by the photosensor SE3 at said step S93 is the first document in the dual feeding mode, the second document in the same mode, or a document in the usual document feeding mode.

The judgments at steps S93 and S94 and the sorts of documents are listed in Table 3. The judgments listed in Table 3 are basically the same as those listed in Table 2.

TABLE 3

| Value of trailing edge counter | Status of dual feeding mode flag | Sorts of feeding mode and document |
|---|---|---|
| "1" | "1" | First document in dual feeding mode |
| "1" | "0" | Usual feeding mode |
| "2" | "1" | Second document in dual feeding mode |

Therefore, in the case of the first document in the dual feeding mode, i.e. when the judgment is "No" at step S93 and when the judgment is "Yes" at step S94, a subroutine for the size detecting mode is executed at step S95, and the size code is memorized in the RAM at step S96. Then, the space counter is started at step S97, the processing proceeds to steP S104. As described at said step S84, the space counter is a counter to measure the distance between the first and second documents.

In the case of the usual document feeding mode, i.e. when the judgment is "No" at step S93 and when the judgment is "No" at step S94, the subroutine for the size detecting mode is executed at step S98, and at step S99 the size code is set so as to be transmitted to the control unit of the copying machine. Further, the trailing edge counter is reset at step S100, the processing proceeds to step S104.

In the case of the second document in the dual feeding mode, i.e. when the judgment is "Yes" at step S93, the subroutine for the document size detecting mode is executed at step SlO!, and a subroutine for setting the transmission of the size code for the dual feeding mode is executed at step S102. In the subroutine, the information obtained by adding the second document size detected at said step S1O1 to the first document size memorized at said step S96 is set so as to be transmitted to the control unit of the copying machine. Further, the trailing edge counter is reset at step S103, and the processing proceeds to step S104.

Next, at step S104, when it is confirmed the completion of the stop timer, the main motor is turned off at step S105, the stopper solenoid is turned off at step S106. Then, the transport operating flag is reset to "0" at step S107, the transport request flag is reset to "0" G. at step S108. Subsequently, the copying start signal is set to "1" so as to be transmitted to the control unit of the copying machine, and the subroutine is terminated.

Figure 7A:
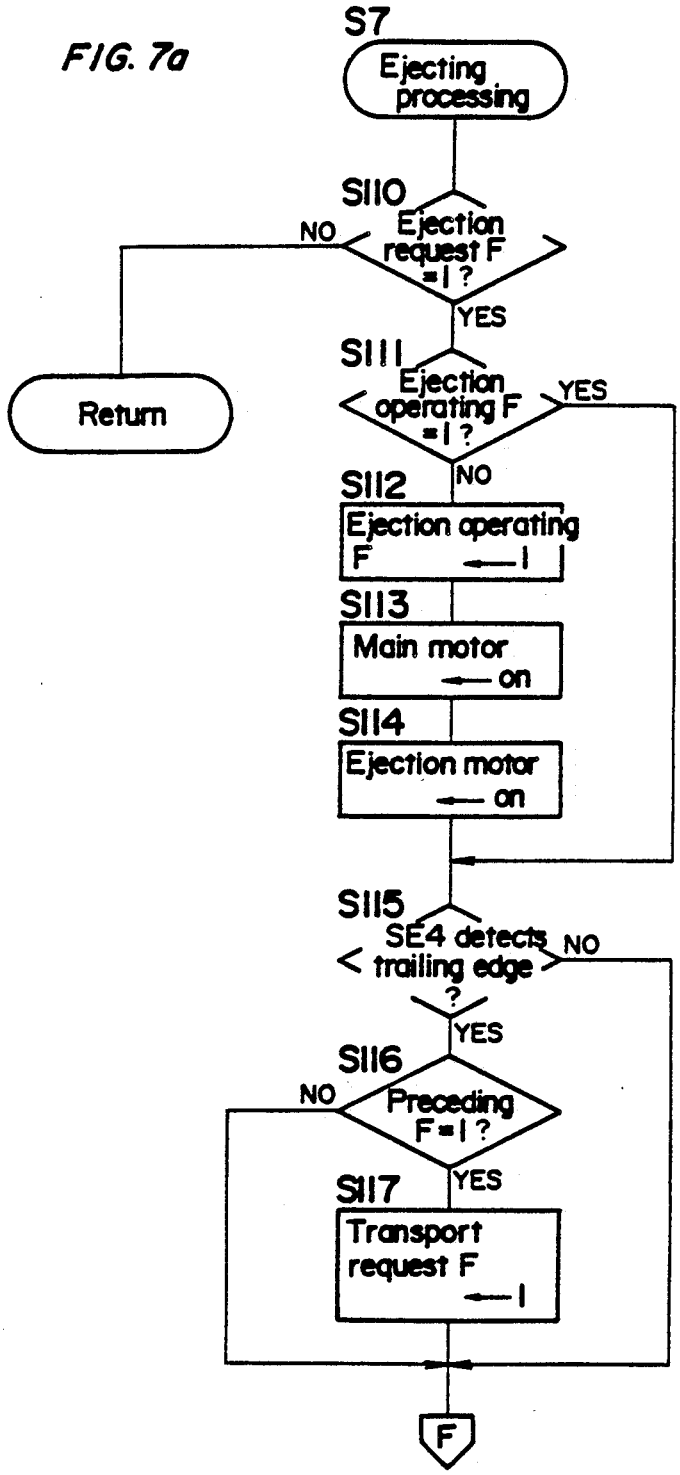
Figure 7B:
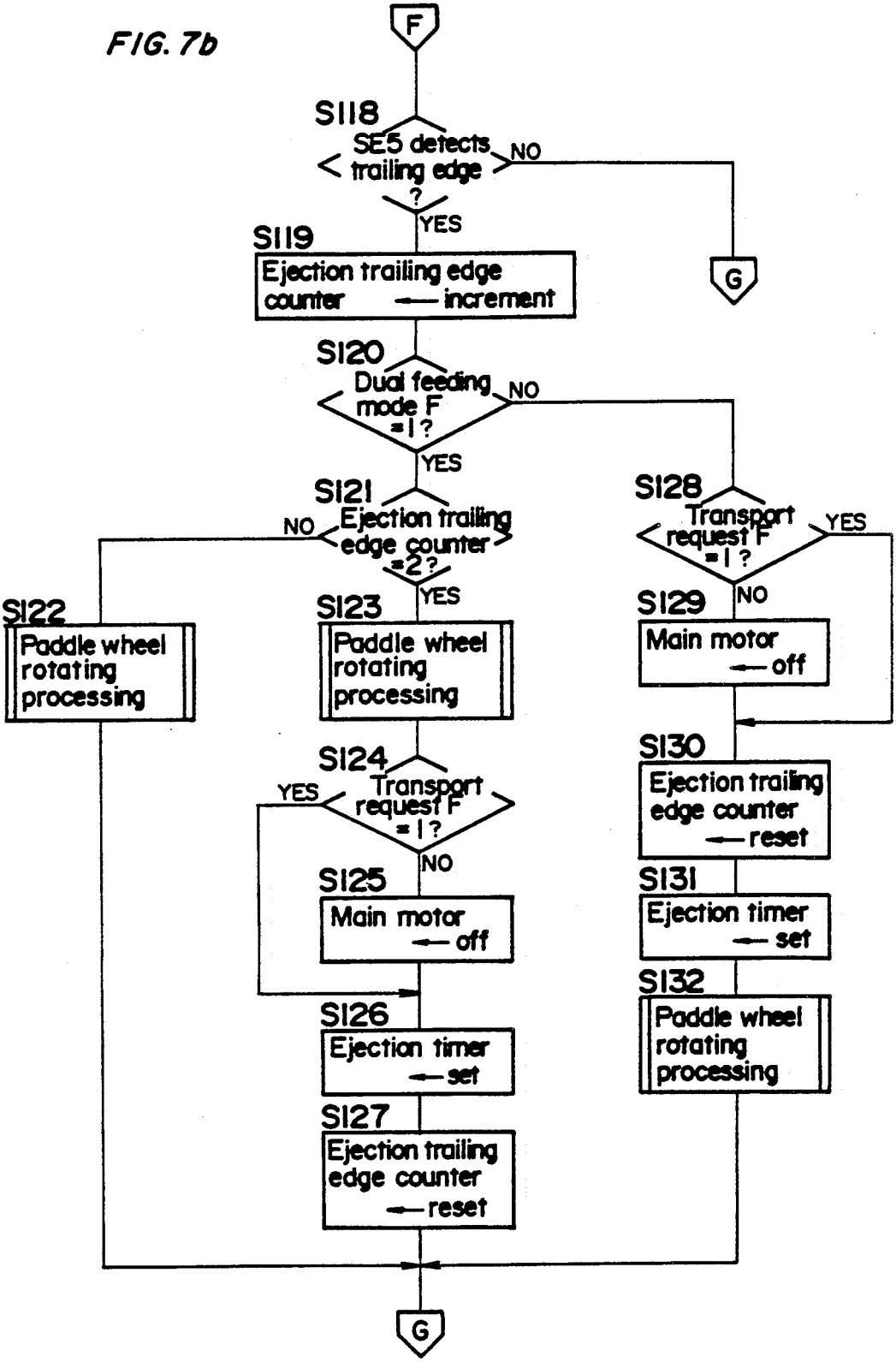
Figure 7C:
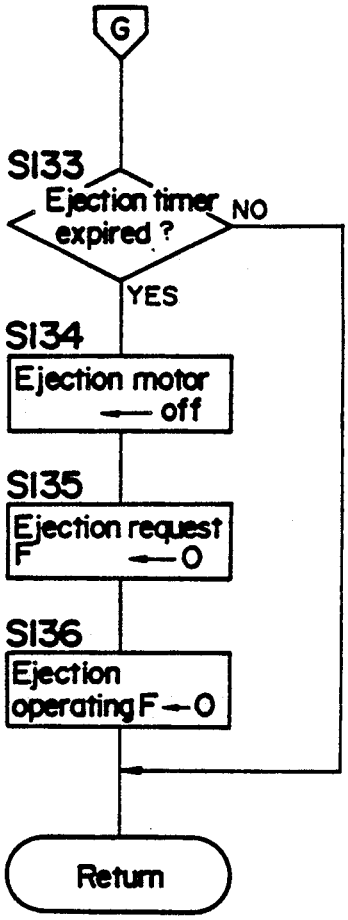

FIGS. 7*a*, 7*b* and 7*c* show the subroutine for the document ejecting processing to be executed at step S7 of the main routine.

First, it is judged at step S110 whether an ejection request flag is "1". When the flag is "0", the processing returns to the main routine. When the flag is "1", it is judged at step S111 whether an ejection operating flag is "1", that is, whether the ejecting operation is in progress. When the ejection operating flag is "1", the processing proceeds to step S115 because the ejecting operation is currently in progress. In contrast, when the ejection operating flag is "0", the flag is set to "1" at step S112, the main motor is turned on at step S113, and the ejection motor is turned on at step S114. This starts the ejection of a document or documents placed on the platen 80.

Next, it is judged at step S115 whether the photosensor SE4 has detected the trailing edge of the document, and it is judged at step S116 whether the preceding flag is "1". This stage is executed so as to both eject a document placed on the platen 80 and start transporting a next document. Therefore, when the trailing edge of the ejected document has passed the detecting point of the photosensor SE4 and when the next document is waiting at the pair of register rollers 15, the document transport request flag is set to "1" G. at step S117.

Next, at step S118 it is judged whether the photosensor SE5 has detected the trailing edge of the document. When the photosensor SE5 has not detected it, the processing proceeds to step S133. When the photosensor SE5 has detected it, a counter for checking whether the ejected document is the first or the second is increased in value by an increment at step S119. The counter is arranged so that the value thereof is increased by an increment as above when the trailing edge of an ejected document is detected by the photosensor SE5. As in the case of the above mentioned leading edge counter and trailing edge counter, the value is counted as "1" G. when the first document is detected, and it is counted as "2" when the second document is detected.

Next, it is judged at step S120 whether the dual feeding mode flag is "1". When the flag is "1", i.e. in the case of the dual feeding mode, it is judged at step S121 whether the value counted by the ejection trailing edge counter is "2". When the counted value is "1", a subroutine for rotating the paddle wheel 6 is executed at S122, and the processing proceeds to step S133. When the counted value is "2", the subroutine for rotating the paddle wheel 6 is executed at step S123. Simultaneously, it is judged at step S124 whether the document transport request flag is "1". When the flag is "1", i.e. when the next document is waiting at the pair of register rollers 15, the processing proceeds to step S126. When the flag is "0", i.e. when the document ejected just now is the last one, the main motor is turned off at step S125. Subsequently, an ejection timer is set at step S126, the ejection trailing edge counter is reset at step S127, and the processing proceeds to step S133.

On the other hand, when it is judged at said step Sl20 that the ADF is in the usual document feeding mode, and when it is confirmed at step S128 that the document transport request flag is "1", the main motor is turned off at step S129. Further, the ejection trailing edge counter is reset at step S130, the ejection timer is set at step S131, the subroutine for rotating the paddle wheel 6 is executed at step S132, and the processing proceeds to step S133.

Next, after waiting the completion of counting cycle of the ejection timer at step S133, the ejection timer is turned off at step S134. At step S135, the document ejection request flag is reset to "0", and the ejection operating flag is reset to "0" G. at step S136, whereby the subroutine for the ejecting processing is completed.

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

For example, the ADF of the present invention may not be a type capable of feeding and circulating one set of documents. The registering means for registering a fed document may be a plate- or claw-shaped gate member instead of a pair of rollers. In addition, as for the means for measuring the distance between the first and second documents in the dual feeding mode, various means constituted in various ways are available, instead of means for counting pulse signals output based on the rotation of a motor. Similarly, as for the control procedure of such means, various other procedures are available.

What is claimed is:

1. An automatic document feeder capable of transporting two documents to a specified position on a platen and arranging the documents in series at the position, which comprises:

means for receiving a plurality of documents loaded in a stack;

means for feeding documents loaded on said receiving means;

means for transporting fed documents onto said platen;

means, provided at one end of said platen, for stopping a first transported document on said platen by interfering with a leading end of the document;

means for detecting a fed document;

means for detecting a fed document;

means for measuring a distance between the first transported document and a subsequently fed document, based on the signal output from said detecting means; and control means for stopping said transporting means during the transportation of said subsequently fed document, based on the value measured by said measuring means, in order to position the subsequently fed document on said platen adjacent the first transported document.

2. An automatic document feeder defined in claim 1, wherein said control means stops said transporting means when the time required for said transporting means to transport a second document for a distance corresponding to the measured distance between two documents has passed after the leading edge of a first document interfered with said stopping means.

3. An automatic document feeder defined in claim 1, wherein said stopping means is movable in and out of a protruding position on said platen.

4. An automatic document feeder capable of transporting two documents to a specified position on a platen and arranging the documents in series at the position, which comprises:

a document deck table for receiving a plurality of documents in a stack;

a first feeder for feeding documents loaded on said document deck table;

a second feeder for transporting fed documents onto said platen;

a stopper, provided at one end of said platen, for stopping a first transported document on said platen by interfering with a leading end of the document;

a detector for detecting a fed document;

a measuring device for measuring a distance between the first transported document and a subsequently fed document, based on the signal output from said detector; and a controller for stopping said second feeder during the transportation of said subsequently fed document, based on the value measured by said measuring device, in order to position the subsequently fed document on said platen adjacent the first transported document.

* * * * *